US012723792B2

(12) United States Patent
Ikawa et al.

(10) Patent No.: US 12,723,792 B2
(45) Date of Patent: Sep. 1, 2026

(54) REFRIGERANT HANDLING DEVICE AND REFRIGERANT HANDLING METHOD

(71) Applicant: DAIKIN INDUSTRIES, LTD., Osaka (JP)

(72) Inventors: Shinsuke Ikawa, Osaka (JP); Katsunori Murata, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 177 days.

(21) Appl. No.: 18/597,055

(22) Filed: Mar. 6, 2024

(65) Prior Publication Data

US 2024/0210081 A1 Jun. 27, 2024

Related U.S. Application Data

(63) Continuation of application No. PCT/JP2022/021316, filed on May 25, 2022.

(30) Foreign Application Priority Data

Sep. 30, 2021 (JP) ..... 2021-160313

(51) Int. Cl.
*F25B 45/00* (2006.01)
*F23G 7/06* (2006.01)

(52) U.S. Cl.
CPC ..... *F25B 45/00* (2013.01); *F23G 7/06* (2013.01); *F25B 2345/002* (2013.01)

(58) Field of Classification Search
CPC ..... F25B 1/00; F25B 49/02; F25B 2400/12; F25B 2345/00
See application file for complete search history.

(56) References Cited

U.S. PATENT DOCUMENTS

| | | | | |
|---|---|---|---|---|
| 2,984,993 | A * | 5/1961 | Carraway | F25B 27/00 62/227 |
| 6,520,096 | B2 | 2/2003 | Takemasa | |
| 11,313,594 | B1 * | 4/2022 | Davis | F25B 1/005 |

FOREIGN PATENT DOCUMENTS

| | | | |
|---|---|---|---|
| CN | 105241105 | A * | 1/2016 |
| EP | 2 686 610 | B1 | 9/2015 |
| JP | 2004333090 | A * | 11/2004 |
| JP | 2009-287533 | A | 12/2009 |
| JP | 2010-111893 | A | 5/2010 |
| JP | 4670419 | B2 | 4/2011 |
| JP | 4860717 | B2 * | 1/2012 |
| JP | 5062812 | B2 | 10/2012 |

(Continued)

OTHER PUBLICATIONS

International Preliminary Report on Patentability and English translation of the Written Opinion of the International Searching Authority for International Application No. PCT/JP2022/021316, dated Apr. 11, 2024.

(Continued)

*Primary Examiner* — Ana M Vazquez
(74) *Attorney, Agent, or Firm* — Birch, Stewart, Kolasch & Birch, LLP

(57) ABSTRACT

A refrigerant handling device (40) includes: a connecting port (41*a*) connectable to a refrigerant circuit (11) provided in a refrigeration apparatus (10) and filled with a flammable refrigerant; and a combustion apparatus (42) configured to combust the refrigerant that has flowed into the combustion apparatus (42) from the connecting port (41*a*).

7 Claims, 4 Drawing Sheets

(56) References Cited

FOREIGN PATENT DOCUMENTS

| | | | |
|---|---|---|---|
| JP | 2016-188724 | A | 11/2016 |
| JP | 2020-143593 | A | 9/2020 |
| JP | 2020-173049 | A | 10/2020 |
| JP | 2020-173050 | A | 10/2020 |

OTHER PUBLICATIONS

International Search Report, issued in PCT/JP2022/021316, PCT/ISA/210, dated Jun. 28, 2022.
Extended European Search Report for European Application No. 22875450.3, dated Oct. 24, 2024.

* cited by examiner

REFRIGERANT HANDLING DEVICE AND REFRIGERANT HANDLING METHOD

CROSS REFERENCE TO RELATED APPLICATIONS

This application is a Continuation of PCT International Application No. PCT/JP2022/021316 filed on May 25, 2022, which claims priority under 35 U.S.C. § 119 (a) to Patent Application No. 2021-160313 filed in Japan on Sep. 30, 2021, all of which are hereby expressly incorporated by reference into the present application.

TECHNICAL FIELD

The present disclosure relates to a refrigerant handling device and a refrigerant handling method.

BACKGROUND ART

Refrigeration apparatuses including a refrigerant circuit filled with a refrigerant with low global warming potential, such as propane or propylene, have been known in the art. In recent years, there has been an increasing demand for a refrigeration apparatus using a refrigerant with low global warming potential to prevent ozone depletion and prevent global warming. Patent Document 1 discloses an air conditioner that employs propane as a refrigerant.

CITATION LIST

Patent Document

Patent Document 1: Japanese Unexamined Patent Publication No. 2016-188724

SUMMARY

A first aspect is directed to a refrigerant handling device including: a connecting port (41*a*) connectable to a refrigerant circuit (11) provided in a refrigeration apparatus (10) and filled with a flammable refrigerant; and a combustion apparatus (42) configured to combust the refrigerant that has flowed into the combustion apparatus (42) from the connecting port (41*a*).

DESCRIPTION OF EMBODIMENT

Embodiments of the present disclosure will be described in detail below with reference to the drawings. The present disclosure is not limited to the embodiments shown below, and various changes can be made within the scope without departing from the technical concept of the present disclosure. Since each of the drawings is intended to illustrate the present disclosure conceptually, dimensions, ratios, or numbers may be exaggerated or simplified as necessary for the sake of ease of understanding.

(1) Configuration of Refrigerant Handling Device

A refrigerant handling device (40) according to an embodiment is a device configured to handle a refrigerant with which a refrigerant circuit (11) of a refrigeration apparatus (10) is filled. The refrigerant with which the refrigerant circuit (11) is filled is a flammable refrigerant. The refrigerant handling device (40) handles, by combustion, the flammable refrigerant.

Figure 1:
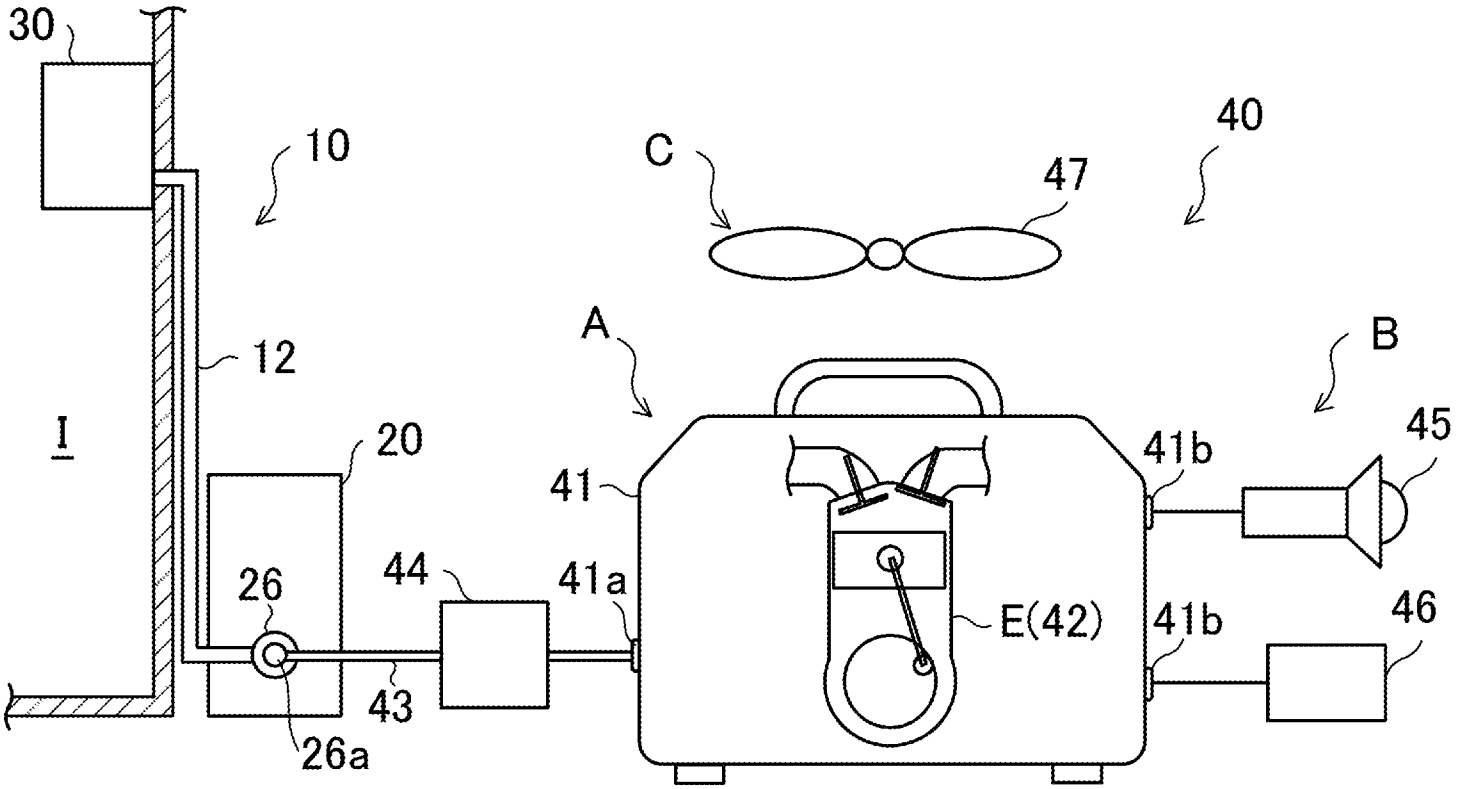
FIG. 1 is an explanatory diagram illustrating a state where a refrigerant handling device of an embodiment is connected to an air conditioner.

As illustrated in FIG. 1, the refrigerant handling device (40) includes a handling section (A) configured to handle the refrigerant, a utilization section (B) configured to utilize energy generated by the handling performed by the handling section (A), and a stirring section (C) configured to stir a substance discharged along with the handling performed by the handling section (A).

(1-1) Handling Section

The handling section (A) includes a casing (41), a connecting port (41*a*), a combustion apparatus (42), and connectors (41*b*). The handling section (A) of this example is a generator that generates electric energy from mechanical energy obtained by combusting gas. The handling section (A) is configured to be portable.

The casing (41) has the connecting port (41*a*). The connecting port (41*a*) is configured to be connectable to the refrigerant circuit (11) of the refrigeration apparatus (10). Specifically, a hose (43) connected to the refrigerant circuit (11) is connected to the connecting port (41*a*). A pressure regulator (44) is disposed at an intermediate portion of the hose (43). In other words, the handling section (A) is connected to the refrigerant circuit (11) via the pressure regulator (44). The pressure regulator (44) regulates the pressure of the refrigerant that has flowed out of the refrigerant circuit (11) to a pressure suitable for handling in the handling section (A).

The combustion apparatus (42) is housed in the casing (41). The combustion apparatus (42) combusts the refrigerant that has flowed in through the connecting port (41*a*). The combustion apparatus (42) of this example is an internal combustion engine (E) that provides combustion using the refrigerant as fuel. The internal combustion engine (E) is a so-called "four-cycle engine" that repeats intake, compression, expansion, and exhaust cycles to generate rotational power.

The utilization section (B) is connected to the connectors (41*b*). The connectors (41*b*) are so-called "sockets," which are openings for insertion of a plug for electric equipment. The electric energy transformed from the mechanical energy produced in the internal combustion engine (E) is supplied through the connectors (41*b*) to the utilization section (B). The handling section (A) of this example has two connectors (41*b*).

(1-2) Utilization Section

The utilization section (B) includes a first device (45) and a second device (46). The first device (45) is electric equipment that consumes energy generated by the internal combustion engine (E). The first device (45) is, for example, a lighting system. The second device (46) is electric equipment that stores energy generated by the internal combustion engine (E). The second device (46) is, for example, a storage battery. The first and second devices (45) and (46) are each connected to an associated one of the connectors (41*b*) of the handling section (A) via a wire.

As can be seen, the refrigerant handling device (40) includes a device that consumes or stores energy generated by the internal combustion engine (E), causing an increase in the electric load on the handling section (A). This facilitates the combustion of the refrigerant in the internal combustion engine (E). The utilization section (B) may be configured as either one of the first device (45) or the second device (46).

(1-3) Stirring Section

The stirring section (C) is configured as a blower (47). The blower (47) is, for example, a circulator having a fan. The blower (47) is driven during combustion of the refrigerant and stirs the air around the handling section (A). Power is supplied to the blower (47) from a power supply different from a power supply for the handling section (A).

Here, combustion of the refrigerant produces substances, which are discharged from the combustion apparatus (42). The substances produced by the combustion may include a substance hazardous to an operator who performs the task of handling the refrigerant. For example, incomplete combustion of propane generates carbon monoxide and soot. To address this problem, in the refrigerant handling device (40) of this example, the blower (47) is driven during the combustion of the refrigerant. This can keep a hazardous substance from staying around the handling section (A) and can keep the operator safe.

(2) Outline of Refrigeration Apparatus

Figure 2:
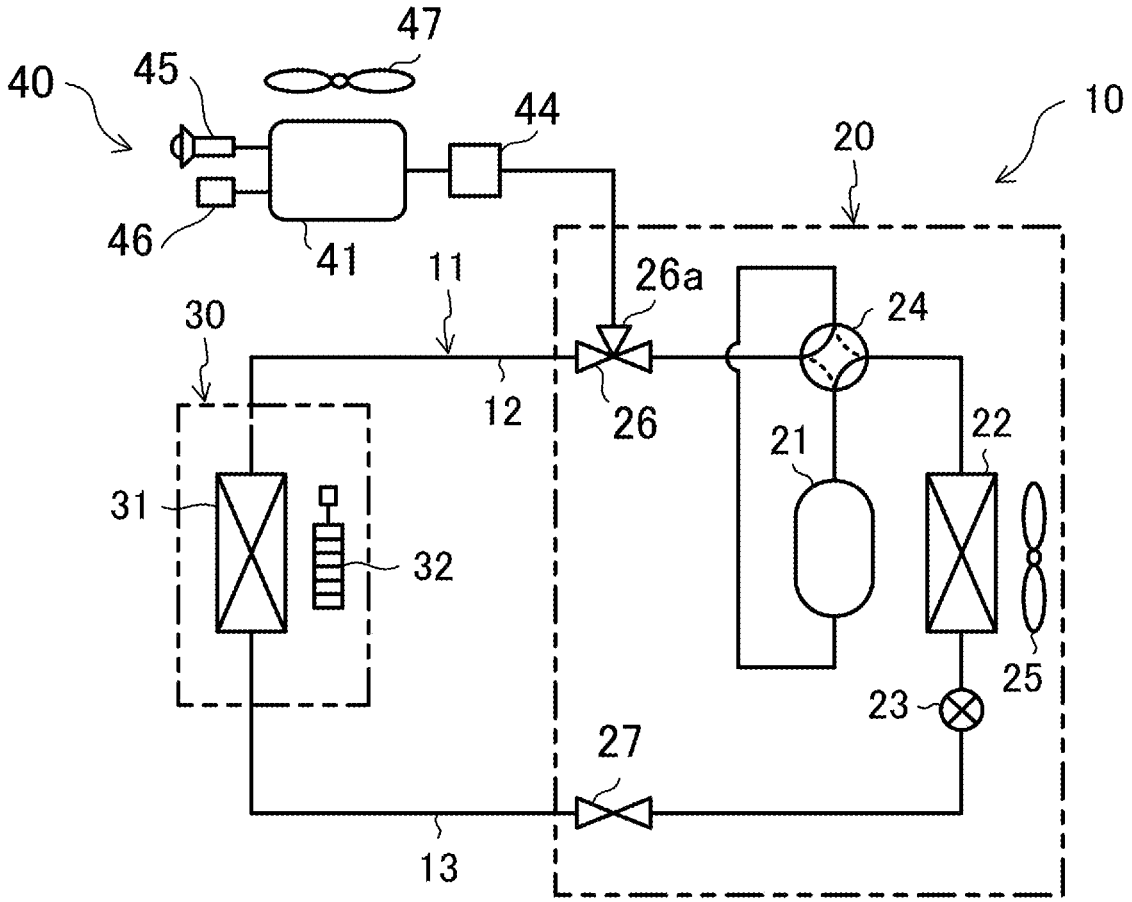
FIG. 2 is an explanatory diagram illustrating a state where the refrigerant handling device is connected to a refrigerant circuit of the air conditioner.

The refrigeration apparatus (10) provided with the refrigerant circuit (11) to which the refrigerant handling device (40) is connected will be described with reference to FIG. 2. The refrigeration apparatus (10) of this example is an air conditioner that adjusts the temperature of the air in an indoor space (I).

(2-1) Air Conditioner

The air conditioner (10) performs a cooling operation and a heating operation. In the cooling operation, the air conditioner (10) cools the air in the indoor space (I). In the heating operation, the air conditioner (10) heats the air in the indoor space (I).

The air conditioner (10) includes the refrigerant circuit (11). The refrigerant circuit (11) is filled with a flammable refrigerant. The refrigerant circuit (11) circulates the refrigerant therethrough to perform a refrigeration cycle.

The air conditioner (10) includes an outdoor unit (20) as a heat source unit, an indoor unit (30) as a utilization unit, a first connection pipe (12), and a second connection pipe (13). The air conditioner (10) is of a pair type that includes one outdoor unit (20) and one indoor unit (30). The outdoor unit (20) includes a compressor (21), an outdoor heat exchanger (22), an expansion valve (23), a four-way switching valve (24), an outdoor fan (25), a gas stop valve (26), and a liquid stop valve (27). The indoor unit (30) includes an indoor heat exchanger (31) and a cross-flow fan (32).

(2-2) Outdoor Unit

The outdoor unit (20) is installed in an outdoor space. The compressor (21) compresses the refrigerant. The compressor (21) is a rotary compressor. The outdoor heat exchanger (22) exchanges heat between the refrigerant and outdoor air. The outdoor heat exchanger (22) is a fin-and-tube heat exchanger. The outdoor fan (25) transfers outdoor air. The air transferred by the outdoor fan (25) passes through the outdoor heat exchanger (22). The outdoor fan (25) is a propeller fan. The expansion valve (23) decompresses the refrigerant. The expansion valve (23) is an electronic or temperature-sensitive expansion valve.

The four-way switching valve (24) reverses the flow of the refrigerant in the refrigerant circuit (11). The four-way switching valve (24) switches between a first state indicated by solid lines in FIG. 2 and a second state indicated by broken lines in FIG. 2. The four-way switching valve (24) in the first state makes a discharge side of the compressor (21) and a gas side of the outdoor heat exchanger (22) communicate with each other, and simultaneously makes a suction side of the compressor (21) and a gas side of an indoor heat exchanger (31) communicate with each other. The four-way switching valve (24) in the second state makes the discharge side of the compressor (21) and the gas side of the indoor heat exchanger (31) communicate with each other, and simultaneously makes the suction side of the compressor (21) and the gas side of the outdoor heat exchanger (22) communicate with each other.

The gas stop valve (26) is located between the first connection pipe (12) and the four-way switching valve (24) in the refrigerant circuit (11). The gas stop valve (26) has a service port (**26*a*). The service port (26*a*) is an opening for filling the outdoor unit (20) with the refrigerant or in measuring the pressure of the refrigerant. During a normal operation of the air conditioner (10), the service port (26*a*) is maintained in a closed state. The refrigerant handling device (40) is connected to the service port (26*a*) via the hose (43) in handling the refrigerant in the refrigerant circuit (11**).

The liquid stop valve (27) is located between the second connection pipe (13) and the expansion valve (23) in the refrigerant circuit (11). The gas stop valve (26) and the liquid stop valve (27) are located, for example, on a side surface of a casing of the outdoor unit (20).

(2-3) Indoor Unit

The indoor unit (30) is installed in the indoor space (I). The indoor heat exchanger (31) exchanges heat between the refrigerant and indoor air. The indoor heat exchanger (31) is a fin-and-tube heat exchanger. The cross-flow fan (32) is an indoor fan configured to transfer indoor air. The air transferred by the cross-flow fan (32) passes through the indoor heat exchanger (31).

(2-4) First and Second Connection Pipes

The first and second connection pipes (12) and (13) connect the indoor unit (30) and the outdoor unit (20) together. The first connection pipe (12) is a gas pipe, and the second connection pipe (13) is a liquid pipe. The first connection pipe (12) has one end connected to the gas stop valve (26), and the other end connected to a gas end of the indoor heat exchanger (31). The second connection pipe (13) has one end connected to the liquid stop valve (27), and the other end connected to a liquid end of the indoor heat exchanger (31).

(2-5) Refrigerant and Refrigerating Machine Oil

The refrigerant circuit (11) is filled with a flammable natural refrigerant. The refrigerant with which the refrigerant circuit (11) is filled has an ignition temperature equal to or lower than 500° C. The refrigerant in this example is propane (R290), which is a highly flammable natural refrigerant. The natural refrigerant has zero ozone depletion potential and low global warming potential, and exerts less load on the environment. Propane ignites at a temperature equal to or lower than 500° C.

The flammable refrigerant with which the refrigerant circuit (11) is filled may be other than propane. The flammable refrigerant with which the refrigerant circuit (11) is filled may be, for example, ammonia (R717), which is a natural refrigerant. Alternatively, the flammable refrigerant with which the refrigerant circuit (11) is filled may be methane (R50), ethane (R170), butane (R600), or isobutane (R600a), which is a highly flammable natural refrigerant.

The refrigerant circuit (11) is filled with a refrigerating machine oil. The refrigerating machine oil is used to lubricate the compressor (21) and other components.

(3) Operation of Air Conditioner

Next, operation of the air conditioner (10) will be described. The air conditioner (10) performs a cooling operation and a heating operation.

(3-1) Cooling Operation

In the cooling operation, the four-way switching valve (24) is brought into the first state. In the cooling operation, the compressor (21), the outdoor fan (25), and the cross-flow fan (32) operate, and the opening degree of the expansion valve (23) is adjusted.

The refrigerant circuit (11) during the cooling operation performs a refrigeration cycle (cooling cycle) in which the outdoor heat exchanger (22) functions as a radiator and the indoor heat exchanger (31) functions as an evaporator.

(3-2) Heating Operation

During the heating operation, the four-way switching valve (24) is brought into the second state. In the heating operation, the compressor (21), the outdoor fan (25), and the cross-flow fan (32) operate, and the opening degree of the expansion valve (23) is adjusted.

The refrigerant circuit (11) during the heating operation performs a refrigeration cycle (heating cycle) in which the indoor heat exchanger (31) functions as a radiator and the outdoor heat exchanger (22) functions as an evaporator.

(4) Refrigerant Handling Method

Figure 3:
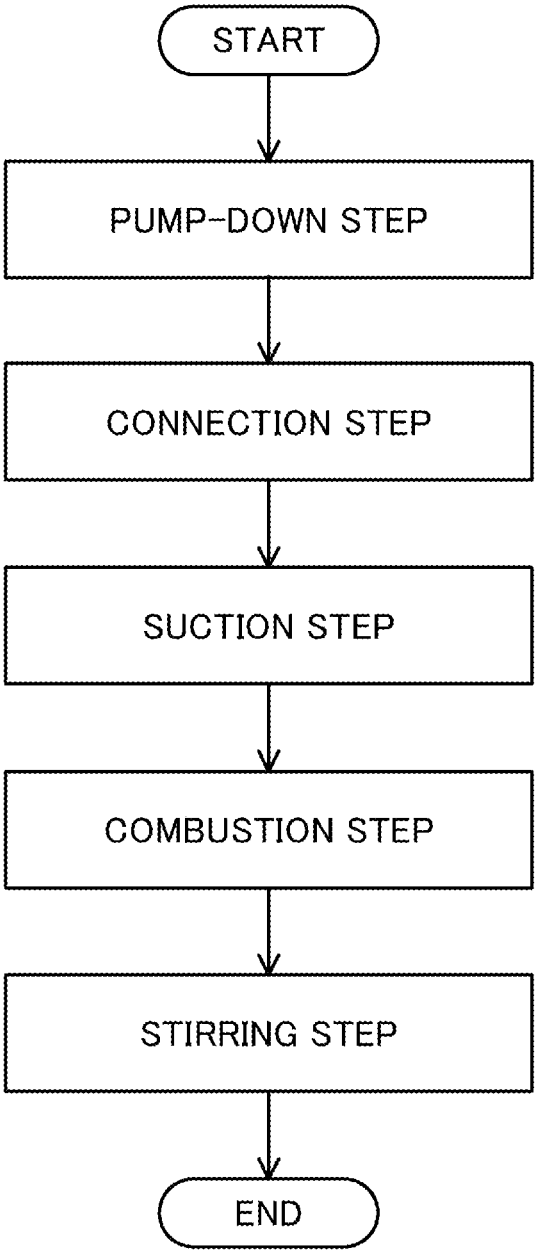
FIG. 3 is a flowchart showing a refrigerant handling method by the refrigerant handling device.

Next, a refrigerant handling method for handling the flammable refrigerant with which the refrigerant circuit (11) is filled will be described. As shown in FIG. 3, in the refrigerant handling method, a pump-down step, a connection step, a suction step, a combustion step, and a stirring step are performed sequentially.

(4-1) Pump-Down Step

The pump-down step corresponds to a fourth step of the present disclosure. In the pump-down step, the air conditioner (10) performs a pump-down operation of moving the refrigerant in the indoor unit (30) to the outdoor unit (20) side.

Specifically, in the pump-down step, the operator closes only the liquid stop valve (27) from the state where the gas stop valve (26) and the liquid stop valve (27) of the outdoor unit (20) are open. Thereafter, the cooling operation is performed. Thus, the refrigerant in the indoor unit (30), the first connection pipe (12), and the second connection pipe (13) is sucked by the compressor (21) and moves into the outdoor unit (20). Next, the operator closes the gas stop valve (26). Thus, the refrigerant in the refrigerant circuit (11) is accumulated in the outdoor unit (20) side.

The pump-down step makes less refrigerant left in the indoor unit (30), the first connection pipe (12), and the second connection pipe (13). Thus, even when the outdoor unit (20) is disconnected for maintenance or relocation of the air conditioner (10), it is possible to keep the refrigerant from leaking from the indoor unit (30) side and being released into the atmosphere.

(4-2) Connection Step

The connection step corresponds to a first step of the present disclosure. In the connection step, the connecting port (41*a*) of the refrigerant handling device (40) is connected to the refrigerant circuit (11) of the air conditioner (10).

Specifically, in the connection step, the operator initially connects the hose (43) to the service port (26*a*) of the gas stop valve (26). Next, the operator attaches the pressure regulator (44) to the hose (43) and connects the hose (43) to the connecting port (41*a*) of the refrigerant handling device (40). Next, the operator opens the service port (26*a*). When the service port (26*a*) is opened, the pressure regulator (44) lowers the pressure of the high-pressure refrigerant that has flowed out of the refrigerant circuit (11) to regulate the pressure to a pressure suitable for handling through the refrigerant handling device (40).

(4-3) Suction Step

The suction step corresponds to a second step of the present disclosure. In the suction step, the refrigerant remaining in the indoor unit (30) is sucked into the combustion apparatus (42) through the connecting port (41*a*).

Specifically, in the suction step, the operator actuates the combustion apparatus (42) of the handling section (A). The actuation of the combustion apparatus (42) causes the suction of the refrigerant whose pressure is adjusted to a low pressure by the pressure regulator (44).

(4-4) Combustion Step

The combustion step corresponds to a third step of the present disclosure. In the combustion step, the refrigerant that has flowed into the combustion apparatus (42) through the connecting port (41*a*) is combusted.

Specifically, combustion of the refrigerant starts when the refrigerant flows into the combustion apparatus (42) through the connecting port (41*a*). At this time, the mixing ratio of the refrigerating machine oil, which is the proportion of the mass of the refrigerating machine oil in the total mass of the refrigerant and the refrigerating machine oil flowing in from the connecting port (41*a*), is equal to or less than 50%. In other words, the mixture containing the refrigerating machine oil at a mixing ratio equal to or less than 50% is combusted in the internal combustion engine (E).

The mixing ratio of this refrigerating machine oil is preferably equal to or less than 25%. The refrigerating machine oil with such a low mixing ratio of the refrigerating machine oil does not affect the combustion of the refrigerant in the combustion apparatus (42). Thus, the refrigerant is appropriately combusted. Combustion of propane, which is the refrigerant of this example, causes reaction with oxygen in the air, generating carbon dioxide and water, which are released from the refrigerant handling device (40).

When the refrigerant is combusted in the combustion apparatus (42), the mechanical energy produced in the internal combustion engine (E) is transformed into electric energy. This electric energy is used in the first device (45) and the second device (46). This enables use of the energy produced by the combustion of the refrigerant and increases the electric load on the handling section (A), thereby facilitating the combustion of the refrigerant.

(4-5) Stirring Step

The stirring step corresponds to a fifth step of the present disclosure. In the stirring step, the air around the combustion apparatus (42) is stirred.

Specifically, the operator operates the blower (47) located near the handling section (A) to lower the concentration, in the air, of the substance released from the handling section (A). Here, as the combustion apparatus (42) operates, a substance hazardous to the operator may be discharged from the combustion apparatus (42). Operating the blower (47) while the combustion apparatus (42) operates can keep the hazardous substance from staying around the combustion apparatus (42) and keep the operator safe.

The stirring step merely needs to be performed during the operation of the combustion apparatus (42), and may be started before any one of the pump-down step, the connection step, the suction step, or the combustion step.

When the combustion of the refrigerant remaining in the indoor unit (30) ends in the combustion apparatus (42), the handling section (A) stops, and the first device (45) and the second device (46) also stop. The operator stops the blower (47) after the stop of the refrigerant handling device (40).

(5) Features (5-1) The refrigerant handling device (40) includes: the connecting port (41*a*) connectable to the refrigerant circuit (11) filled with the flammable refrigerant; and the combustion apparatus (42) configured to combust the refrigerant that has flowed therein through the connecting port (41*a*). It is thus possible to combust and handle the refrigerant by simply connecting the connecting port (41*a*) of the refrigerant handling device (40) to the refrigerant circuit (11). The flammable refrigerant can thus be handled easily.

Ignition of the flammable refrigerant may occur if the flammable refrigerant leaks during the maintenance or relocation of the refrigeration apparatus (10). In the refrigerant handling device (40) of this embodiment, the flammable refrigerant is combusted and handled in the combustion apparatus (42) on the site where the refrigeration apparatus (10) is installed. This can reduce the risk of the refrigerant leakage.

In addition, notification and permission prior to the work day are required in recovering the flammable refrigerant. The refrigerant handling device (40) of this embodiment allows the flammable refrigerant to be handled on the site where the refrigeration apparatus (10) is installed. This eliminates the need for notification and reduces the labor required to prepare for the handling.

(5-2) The ignition temperature of the refrigerant to be handled in the refrigerant handling device (40) is equal to or lower than 500° C. Thus, the refrigerant ignites and is combusted in the combustion apparatus (42) at 500° C. or lower.

(5-3) The refrigerant to be handled in the refrigerant handling device (40) is a natural refrigerant. Since the refrigerant to be charged is the natural refrigerant, the load of the refrigeration apparatus (10) on the environment is reduced.

(5-4) The refrigerant to be handled in the refrigerant handling device (40) is a highly flammable natural refrigerant. The refrigerant that is a highly flammable natural refrigerant has a very high risk of ignition if it leaks during maintenance or relocation of the refrigeration apparatus (10). In the refrigerant handling device (40) of this embodiment, the refrigerant is combusted on the site where the refrigeration apparatus (10) is installed. This can reduce the risk of the refrigerant leakage and enables safe handling of the refrigerant.

(5-5) The combustion apparatus (42) of the refrigerant handling device (40) is an internal combustion engine (E) that combusts the refrigerant. Thus, the refrigerant handling device (40) of this embodiment can handle the refrigerant more safely than in a case in which the refrigerant is combusted with an open fire.

(5-6) The refrigerant handling device (40) further includes the first device (45) that consumes energy generated by the internal combustion engine (E). This increases the electric load on the refrigerant handling device (40), thereby facilitating the combustion of the refrigerant.

(5-7) The refrigerant handling device (40) further includes the second device (46) that stores energy generated by the internal combustion engine (E). This increases the electric load on the refrigerant handling device (40), thereby facilitating the combustion of the refrigerant.

(5-8) The refrigerant handling device (40) further includes the blower (47) that stirs the air around the combustion apparatus (42). The blower (47) is driven during combustion of the refrigerant. Here, due to the combustion of the refrigerant, a substance hazardous to the operator may be discharged from the combustion apparatus (42). The blower (47) driven during the combustion of the refrigerant can keep the discharged hazardous substance from staying around the combustion apparatus (42) and keep the operator safe.

(5-9) The refrigerant circuit (11) is further filled with the refrigerating machine oil for lubricating the compressor (21). The proportion of the mass of the refrigerating machine oil in the total mass of the refrigerant and the refrigerating machine oil flowing in from the connecting port (41*a*) of the refrigerant handling device (40) is equal to or less than 50%. That is, the internal combustion engine (E) combusts the mixture in which the proportion of the mass of the refrigerating machine oil in the total mass of the refrigerant and the refrigerating machine oil flowing in from the connecting port (41*a*) is equal to or less than 50%.

(5-10) The refrigerant handling method of this embodiment includes the connection step of connecting the connecting port (41*a*) of the refrigerant handling device (40) to the refrigerant circuit (11), the suction step of sucking the refrigerant into the combustion apparatus (42) of the refrigerant handling device (40) through the connecting port (41*a*) connected to the refrigerant circuit (11), and the combustion step of combusting the refrigerant sucked through the connecting port (41*a*) in the combustion apparatus (42). Since the refrigerant is combusted and handled in the combustion apparatus (42) on the site where the refrigeration apparatus (10) is installed, the flammable refrigerant with which the refrigerant circuit (11) is filled can be handled easily.

(5-11) The refrigerant handling method of this embodiment further includes the pump-down step of performing the pump-down operation of moving the refrigerant in the indoor unit (30) to the outdoor unit (20) side. In the refrigerant handling method, the connection step is performed after the end of the pump-down step. In the suction step, the refrigerant remaining in the indoor unit (30) is sucked. As described above, the connection step is performed after the end of the pump-down step, and the refrigerant remaining on the indoor unit (30) side is sucked in the suction step and combusted in the combustion step. This decreases the refrigerant remaining on the indoor unit (30) side. This reduces the risk of the refrigerant leakage from the indoor unit (30) side.

(5-12) The refrigerant handling method of this embodiment further includes the stirring step of stirring air around the combustion apparatus (42). In the combustion step, a substance hazardous to the operator may be discharged from the combustion apparatus (42). To address this problem, the air around the combustion apparatus (42) is stirred in the stirring step, which can keep the discharged hazardous substance from staying around the combustion apparatus (42) and keep the operator safe.

(6) Variations

The foregoing embodiment may be modified as the following variations. In the following description, differences from the embodiment will be described in principle.

(6-1) First Variation

Figure 4:
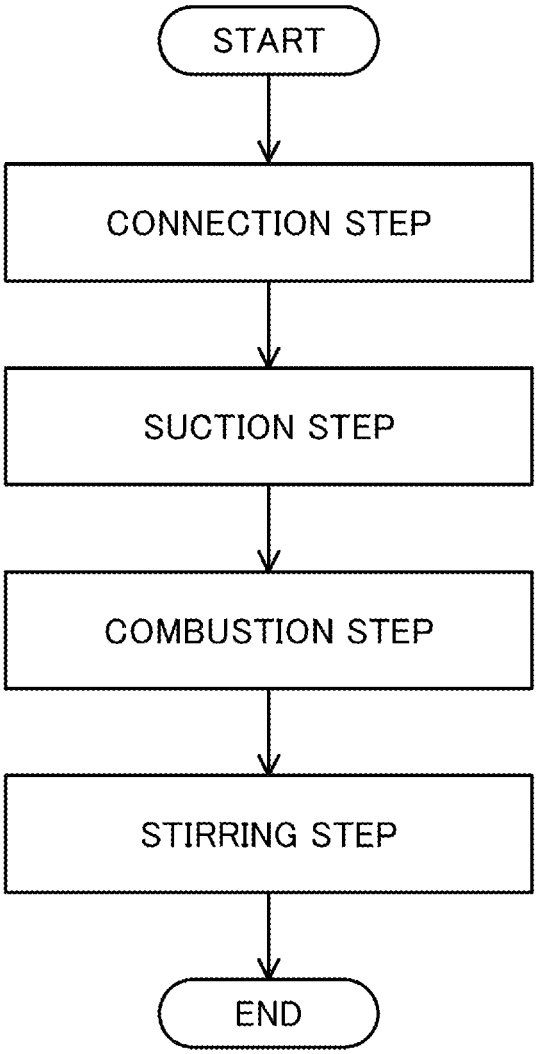
FIG. 4 is a flowchart in a first variation and corresponds to FIG. 3.

As illustrated in FIG. 4, if the air conditioner (10) does not perform the pump-down operation, the connection step, the suction step, the combustion step, and the stirring step may be sequentially performed in the refrigerant handling method. The phrase "if the air conditioner (10) does not perform the pump-down operation" indicates, for example, a situation where the pump-down operation cannot be performed due to a breakdown of the air conditioner (10) or a situation where the air conditioner (10) does not have the function of performing the pump-down operation.

In this example, the operator closes the gas stop valve (26) and the liquid stop valve (27) before performing the connection step. Accordingly, the outdoor unit (20) and the indoor unit (30) side (the indoor unit (30), the first connection pipe (12), and the second connection pipe (13)) are shut off from each other. Since the pump-down step is not performed in this variation, the refrigerant is present on the indoor unit (30) side as well. The connection step, the suction step, and the combustion step are performed in this state, thereby causing combustion of the refrigerant on the indoor unit (30) side in the refrigerant handling device (40). The refrigerant on the indoor unit (30) side is combusted in this way. It is therefore possible to keep the refrigerant from being released into the atmosphere even if the outdoor unit (20) and the indoor unit (30) side are disconnected from each other for maintenance and relocation of the air conditioner (10).

The gas stop valve (26) and the liquid stop valve (27) do not have to be closed before the connection step. In this case, the entire refrigerant in the refrigerant circuit (11) is combusted and handled in the refrigerant handling device (40).

(6-2) Second Variation

The first device (45) of the utilization section (B) may be a blower (47). In this case, the blower (47) is connected to the connector (41*b*) of the handling section (A). In other words, the blower (47) serves as both the utilization section (B) and the stirring section (C).

It is thus possible to keep a hazardous substance discharged from the combustion apparatus (42) from staying around the combustion apparatus (42) and keep the operator safe, while utilizing the electric energy generated by the handling section (A).

(6-3) Third Variation

The refrigerant handling device (40) may include only the handling section (A). In other words, the refrigerant handling device (40) does not have to include the first and second devices (45) and (46) serving as the utilization section (B), and the blower (47) serving as the stirring section (C).

(6-4) Fourth Variation

The combustion apparatus (42) of the handling section (A) may combust the refrigerant using a component other than the internal combustion engine (E). For example, the combustion apparatus (42) may be a combustion furnace. In this case, the refrigerant is combusted with an open fire in the combustion furnace.

Other Embodiments

The foregoing embodiment may be modified as follows.

In the refrigerant handling device (40) of the foregoing embodiment, the utilization section (B) may directly use the mechanical energy generated by the internal combustion engine (E) without transforming the mechanical energy into electric energy. For example, the blower (47) may be operated by the rotational power produced in the internal combustion engine (E).

While the embodiments and variations thereof have been described above, it will be understood that various changes in form and details may be made without departing from the spirit and scope of the claims. The embodiments, the variations, and the other embodiments may be combined and replaced with each other without deteriorating intended functions of the present disclosure.

The expressions of "first," "second," "third," . . . described above are used to distinguish the words to which these expressions are given, and the number and order of the words are not limited.

INDUSTRIAL APPLICABILITY

As can be seen from the foregoing description, the present disclosure is useful for a refrigerant handling device and a refrigerant handling method.

EXPLANATION OF REFERENCES

10 Refrigeration Apparatus (Air Conditioner)
11 Refrigerant Circuit
20 Outdoor Unit (Heat Source Unit)
21 Compressor
30 Indoor Unit (Utilization Unit)
40 Refrigerant Handling Device
41*a* Connecting Port
42 Combustion Apparatus
45 First Device
46 Second Device
47 Blower
E Internal Combustion Engine

The invention claimed is:

1. A refrigerant handling device comprising:
a connecting port connectable to a refrigerant circuit provided in a refrigeration apparatus and filled with a flammable refrigerant; and
a combustion apparatus configured to combust the refrigerant that has flowed into the combustion apparatus from the connecting port; and
a first device configured to consume energy generated by an internal combustion engine, wherein
the combustion apparatus is the internal combustion engine configured to combust the refrigerant, and
the first device is a blower configured to stir air around the combustion apparatus.

2. The refrigerant handling device of claim 1, wherein
the refrigerant has an ignition temperature equal to or lower than 500° C.

3. The refrigerant handling device of claim 2, wherein
the refrigerant is a natural refrigerant.

4. The refrigerant handling device of claim 3, wherein
the refrigerant is a highly flammable natural refrigerant.

5. The refrigerant handling device of claim 1, wherein
the refrigerant circuit is further filled with a refrigerating machine oil for lubricating a compressor included in the refrigeration apparatus, and
a proportion of a mass of the refrigerating machine oil in a total mass of the refrigerant and the refrigerating machine oil flowing in from the connecting port is equal to or less than 50%.

6. A refrigerant handling method for handling a flammable refrigerant with which a refrigerant circuit of a refrigeration apparatus is filled, the method comprising:

a first step of connecting a connecting port of a refrigerant handling device to the refrigerant circuit;

a second step of sucking the refrigerant into a combustion apparatus of the refrigerant handling device through the connecting port connected to the refrigerant circuit; and a third step of combusting the refrigerant sucked through the connecting port in the combustion apparatus, where in the refrigeration apparatus has a heat source unit and a utilization unit connected to the heat source unit to form the refrigerant circuit, the method further includes a fourth step of performing a pump-down operation of moving the refrigerant in the utilization unit to a heat source unit side, the first step is performed after an end of the fourth step, and in the second step, the refrigerant remaining in the utilization unit is sucked.

7. The method of claim 6 further comprising:

a fifth step of stirring air around the combustion apparatus.

* * * * *